United States Patent [19]

Kelmar

[11] Patent Number: 4,670,049

[45] Date of Patent: Jun. 2, 1987

[54] OXYGEN BLAST FURNACE FOR DIRECT STEEL MAKING

[76] Inventor: John J. Kelmar, 2205 Cypress Dr., McKeesport, Pa. 15131

[21] Appl. No.: 810,555

[22] Filed: Dec. 19, 1985

Related U.S. Application Data

[63] Continuation-in-part of Ser. No. 602,956, Apr. 23, 1984, abandoned.

[51] Int. Cl.[4] ..... C21B 5/56

[52] U.S. Cl. ..... 75/41; 75/59.11; 75/59.18

[58] Field of Search ..... 75/41, 42, 59.11, 59.18; 266/197

[56] References Cited

U.S. PATENT DOCUMENTS 1,601,015 9/1926 Aarts ..... 266/197

3,460,934 8/1969 Kelmar ..... 75/41

*Primary Examiner*—Melvyn J. Andrews

*Attorney, Agent, or Firm*—Carothers & Carothers

[57] ABSTRACT

A method and apparatus for direct steel making in a blast furnace wherein a continuous flow of process ingredients including iron ore is directed in a descending tortuous path through reduction and combustion zones which are maintained in the shaft of a blast furnace.

12 Claims, 3 Drawing Figures

OXYGEN BLAST FURNACE FOR DIRECT STEEL MAKING

This is a continuation-in-part of copending application Ser. No. 602,956 filed Apr. 23, 1984 now abandoned.

This invention concerns steel making in an oxygen blast furnace. The operation of a blast furnace in making iron is well known. Briefly, the furnace is charged from the top to form within the furnace shaft a column of iron ore, limestone, and structural coke of sufficient strength to support the furnace charge to a depth of 90 to 100 feet. A hot air blast is forced through tuyeres at the bottom of the packed furnace to furnish heat and oxygen for the combustion of the coke in the furnace charge. The resulting gas passes up through the furnace shaft and reduces the ore, coke and flux to molten metal and slag, and then issues from the top of the furnace as dust-laden lean combustible gas. The stock column descends in the furnace shaft at a rate of about 10 feet per hour as the structural coke is consumed, and molten iron and slag form a pool and separate in the bottom of the furnace, which is tapped intermittently.

The working volume of a conventional blast furnace is the volume through which the gas produced at the tuyeres passes in contact with the materials in the furnace charge. The theoretical speed at which the materials of the furnace charge descend in the furnace is about 10 feet per hour for air-blown blast furnaces, and the materials charged into the furnace to produce one ton of iron typically comprise about 2 tons of ore, 0.9 tons of coke, 0.4 tons of limestone and 3.5 tons of air. One prior method of making steel in a conventional blast furance is disclosed in my U.S. Pat. No. 3,460,934, the entire specification of which is incorporated herein and made a part hereof by reference.

The present invention pertains to improvements over the prior U.S. Pat. No. 3,460,934 wherein the direct reduction zone of the furnace is modified by incorporation of additional heating from multiple tuyeres and a cascading process material flow path over step structures installed in the furnace shaft. These improvements permit elimination of the moving bed stock column in the furnace shaft and replace it with a continuous free falling flow of process ingredients. Since the production rate of a furnace which utilizes the conventional stock column of process ingredients and structural coke is limited by the rate of descent of the stock column, elimination of the stock column provides opportunities for immensely improved production rates. In the present instance a blast furnace having a capacity of 4000 tons per day can, by use of this invention, produce about 12,000 tons of metal per day. Furthermore, the end product will be refined steel rather than reduced iron.

The sloping or inclined steps are constructed in the shaft of the furnace of refractory material to provide for a cascading flow of the furnace charge materials downward from the stockline through a tortuous flow path. The charge materials enter at the top of the furnace to form a free falling curtain circumferentially around the lower bell of the furnace inlet, and then cascade downward from the stockline to the slag surface near the bottom to the furnace in approximately 20 minutes.

In conjunction with the utilization of the described sloping step structure, water cooling may be provided in the step structures to reduce deleterious effects from exposure to high temperatures. The furnace is thus provided with an upper reduction zone in the shaft in which a temperature of approximately 1700° F. to 2000° F. is maintained, and a lower combustion zone in the hearth where a higher temperature is maintained, for example approximately 3650° F. A plurality of tuyeres is provided for injecting oxygen and recycled gas directly into the upper reduction zone of the furnace. The invention thus provides for direct steel making by means of a continuous process of cascading raw material flow downward over a series of staggered, inclined steps through a first lower temperature reduction zone and then into a higher temperature combustion zone in the hearth of the furnace. In addition to the conventional tuyeres locates adjacent to the bottom of the furnace, plural tuyeres are also located for injection of oxygen and recycle gas directly into the reduction zone.

The process permits the injection of scrap steel into the furnace to enhance production rates by taking advantage of recycling opportunities. The recycling is achieved at minimal energy cost since the direct steel making process envolves excess heat which would be otherwise wasted.

Among the advantages of direct steel making according to this invention are the following:

(1) Iron ore is converted to steel in a single reactor, rather than first making iron and then making steel in multiple of processes involving use of multiple reactors.

(2) Consolidation of fumes, transfer of liquid products, and environmental problems are reduced.

(3) Less land urea, equipment and capital investment are required.

(4) The blast furnace may be used simultaneously for coke gasification to produce fuel for production of electricity for the plant, other industries, or the community.

(5) The continuous feed of process materials eliminates "scaffolding" uneven material distribution, and other irregularities of conventional packed tower furnace operation.

(6) The invention permits utilization of all the coke of the coke ovens rather than just the structural grade coke, thus offering enhanced process material economy. Specifically, the coke breeze that is normally screened from the structural coke may be used, thus offering an approximate 10% fuel cost savings.

It is therefore one object of the invention to provide a method for direct steel making in a modified conventional blast furnace.

A more specific object of the invention is to provide a process for continuous, direct steel making in a modified, conventional blast furnace by having the hearth of the furnace perform the function of an open-hearth furnace in the refining of molten iron into steel.

A further object of the invention is to provide for an improved combined process of direct steelmaking and scrap steel recycling in a modified, conventional blast furnace.

Another more specific object of the invention is to provide a process of direct steel making in a conventional blast furnace wherein a series of inclined steps are provided in the furnace shaft and the raw materials are gravitationally cascaded over the steps in countercurrent flow relationship to upwardly directed not reducing gases.

Another object of the invention is to provide, in a blast furnace, a process for direct steel making as above described in which a continuous stream of raw materials of the steel making process are passed gravitationally downward in sequence through a relatively lower temperature reduction zone and a relatively higher temperature combustion zone.

These and other objects and advantages of the invention will be more apparent upon consideration of the following description and accompanying drawings, which show, for the purpose of exemplification without limiting the invention or the claims thereto, certain practical embodiments illustrating the principles of this invention and wherein:

Figure 1:
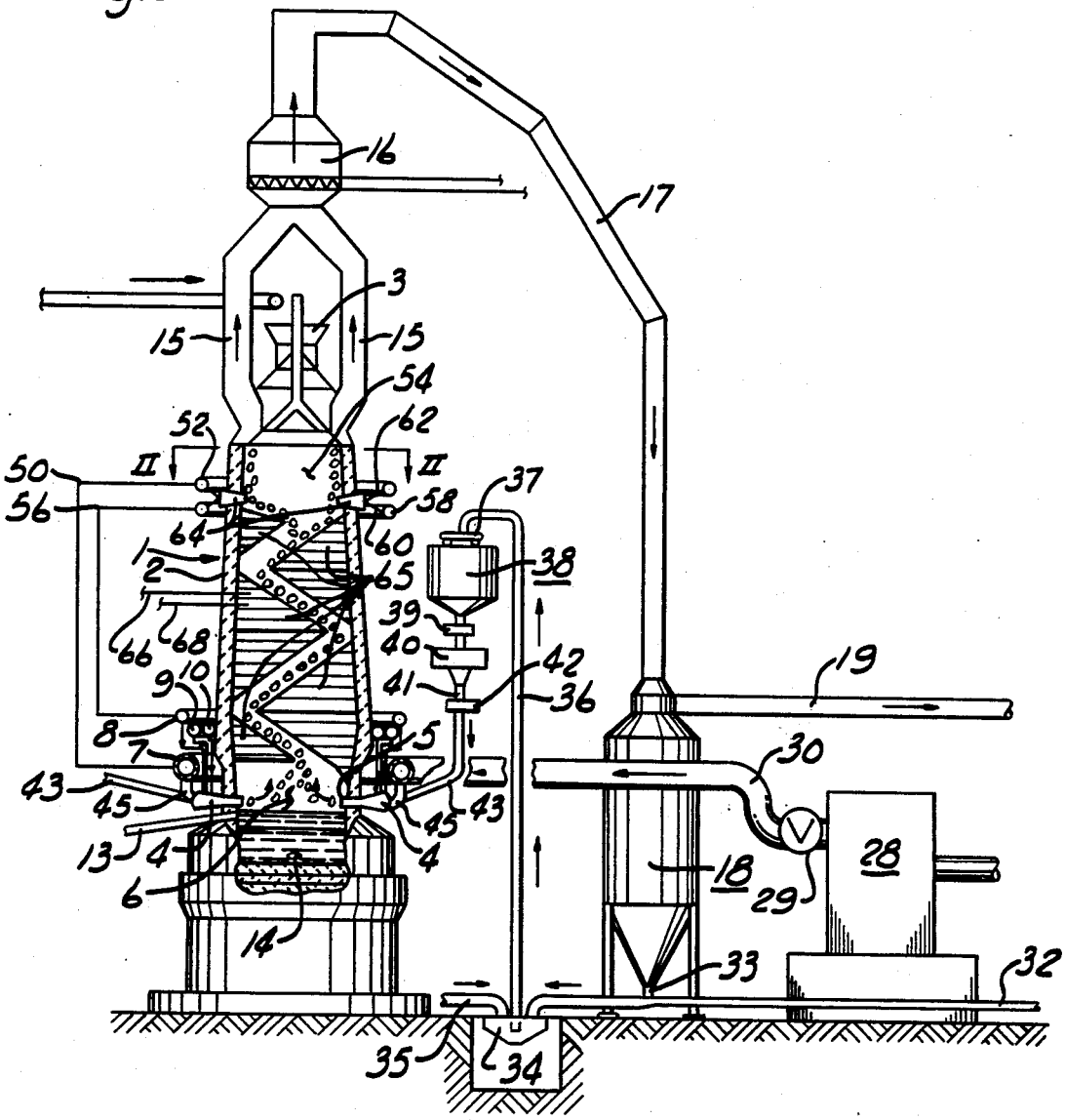
FIG. 1 is a fragmentary, partially sectioned side elevation of a blast furnace steel making apparatus for use according to the process of the present invention.

Referring to the drawings in more detail, the apparatus of the invention is described generally with reference to modification of the blast furnace described in the hereinabove cited U.S. Pat. No. 3,460,934. Accordingly, in FIG. 1 there is shown blast furnace 1 having a stack 2 and a charging hopper 3 for receiving iron ore, limestone and coke. In the bottom of the furnace is a ring of cyclone injectors 4 for receiving, in pulverized form solid constituents including ore, flue dust, coke breeze and limestone. On the injectors 4 are tuyeres or nozzles 5, for projecting the material into zone 6 of the furnace adjacent to the furnace hearth. Circumferentially around the furnace is a bustle pipe 7 for delivering compressed recirculating gas to the cyclone injectors. Rings of pipes 8, 9 and 10 also encircle the furnace for supplying respectively, oxygen, natural gas and fuel oil, at a pressure of 65 p.s.i. for example, via tuyeres 5.

The oxygen and fuel entrain the solid constituents to form a fluidized mass. Combustion of the fluidized mass in the furnace hearth produces hot reducing constituents which ascend through the furnace shaft and exit as top gas through uptake pipes 15 that communicate in a water cooled collecting chamber 16.

From the chamber 16, the gas is led by downcomer pipe 17 into dust separator 18 for separation of the major portion of the dust. The gas from the dust separator is led by line 19 to an electrostatic precipitator (not shown). The cleaned gas leaves the precipitator and a portion thereof is recirculated to a turboblower 28 where the gas is compressed to a pressure of approximately 52 p.s.i., for example, and then fed through valve 29 and line 30 into bustle pipe 7. Flue dust from the precipitator (not shown) is discharged on a conveyor 32 which also receives flue dust from dust separator 18 via outlet 33. The collected flue dust is then discharged into hopper bin 34 and conveyor 35 delivers thereinto coke breeze, fine ore and limestone, with all material passing through a one-half (½) inch mesh screen (not shown). From the hopper bin 34 the composite material is carried by vertical conveyor 36 and discharged into a horizontal conveyor 37 arranged circumferentially around the furnace to feed plural storage tanks 38 which are circumferentially spaced around furnace 1. From each storage tank 38 the material flows into a feeder 39 for regulated flow into a pulverizer 40 and reduction therein to powder form to pass 100 percent through a 50 mesh screen. The material is then discharged via pipe 41 into another feeder 42 where it is regulated for uniform flow into pipe 43 for flow into injectors 4 to provide the solid constituents as above described for injection via injectors 4.

As has been noted, the solid material flowing into the injectors 4 is picked up by the primary gas stream as at 45. The fluidized mass or medium is then projected into the furnace through water cooled tuyeres 5 at a pressure of approximately 24 p.s.i., for example. Accordingly, the furnace burden enters partially through the top of the furnace and partially through tuyeres 5, preferably in the respective approximate proportions of about 82% to about 18%.

Figure 2:
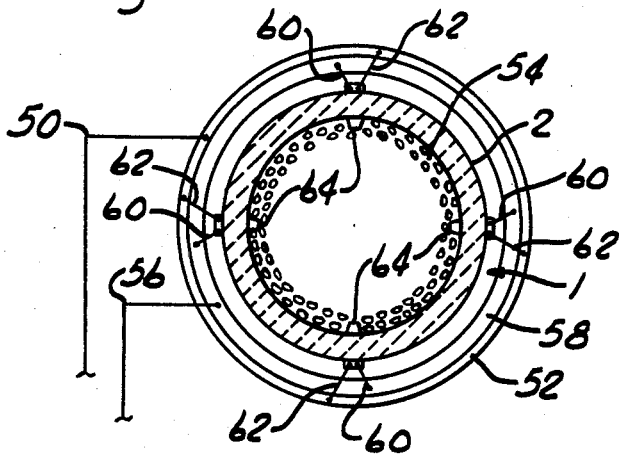
FIG. 2 is a transverse section taken on line II—II of FIG. 1.

Bustle pipe 7 is connected via a conduit 50 to a pipe 52 which encompasses furnace 1 adjacent an upper region 54 thereof. Similarly, oxygen pipe 8 is connected via a conduit 56 with a pipe 58 that encompasses furnace 1 adjacent the pipe 52. As shown in FIG. 2, each of pipes 52 and 58 is connected via respective plural pairs of feed lines 60 and 62 with a plurality of circumferentially spaced tuyeres 64. Accordingly, in practice a mixture of oxygen from pipe 8 and compressed recycled top gas from bustle pipe 7 is injected via tuyeres 64 into upper region 54. The composition of the recycled gas is typically $Co_2$-20%, Co-58%, $H_2$-18%, $H_2O$-3%, $N_2$-1%.

The furnace 1 is also provided with a plurality of vertically spaced apart inclined step structures constructed of suitable refractory material and preferably being water cooled as by water passed within suitably formed flow channels or conduits therein from an inlet 66 to an outlet 68 as shown for one of the step structures 65. Preferably the step structures 65 are disposed within furnace 1 in vertically spaced, laterally overlapping relationship such that the iron ore, limestone, and coke received into the furnace via hopper 3 cascades downwardly over steps 65 in a tortuous flow path and in countercurrent flow relationship to the upwardly flowing reducing gases.

The blast of hot gases issuing from tuyeres 5 into zone 6 and that issuing from tuyeres 64 into zone 54 provide, together with the partial obstruction to gas flow afforded by step structures 65 and the water cooling thereof, a means of establishing two vertically spaced combustion reaction zones within the furnace. Specifically, there is provided a reducing zone including zone 54 of the furnace and extending downwardly therefrom for the direct reduction of iron ore. The reducing zone is maintained at a temperature of approximately 1700° to 2000° F., for example, Beneath the reducing zone is an oxidizing zone in the hearth which is maintained at a temperature of approximately 3650° F., for example.

As explained above, in the practice of this invention the furnace shaft is not filled or packed with burden. Rather, the raw materials are fed via hopper 3 and cascade downwardly over steps 65 in a continuous process. More specifically, the burden being charged into the top of the furnace will consist of iron ore, limestone and coke, all of a particle size preferably not exceeding one inch. In the reducing zone of the furnace the burden encounters an ascending current of hot reduction gases from tuyeres 64 and 5 at a temperature of about 1700° F. to 2000° F., for example.

In the upper region 54, the descending burden, from circular hopper 3, is distributed circumferentially and forms a curtain of falling material. As the burden particles move down the inclined steps 65, cascading from one to the next, the carbon monoxide and hydrogen in the reducing gas stream reduce the iron ore through the process of diffusion into and out of the ore particles. Although the time lapse for the descent of an ore particle through the furnace is short, on the order of 20 minutes for example, the high temperature and other favorable conditions, such as oxygen atmosphere, are adequate to reduce the iron ore. Among the other favorable conditions is the mechanism of cascading the burden successively from one inclined step to the next. As the ore particles move down the inclined steps, fast reaction conditions are promoted by the intimate mixing of metal and slag to maximize the surface area interfacing in the presence of reducing gases at a sufficiently elevated temperature to drive the reducing reaction.

Thus, the residual carbon, the gangue or waste material, the metallic droplets containing reduced substances and some slag containing unreduced substances trickle downward from the direct reduction zone and through the combustion zone. As the coke descends into the combustion zone, it burns thus releasing carbon monoxide and considerable heat to help drive the reducing reaction. The limestone decomposes completely into lime and carbon dioxide at 1800° F. and combines with some of the gangue and with unreduced iron oxide and manganese oxide to form a portion of the slag which, together with that portion of the slag already formed, trickles with the flow of reduced iron and the by-products down the cascade steps 65 and into the molten slag floating on top of the metal bath for refining into steel.

In my blast furnace the reduction process for iron making and the oxidation process for steel making are carried out in a continuous operation as described in my prior U.S. Pat. No. 3,460,934, but without use of the packed tower process described therein. Specifically, the metallic iron, containing reduced substance, and the slag, containing unreduced substance or oxides, trickles down from the smelting zone or bosh and passes through the combustion zone and are then collected in the hearth with the molten slag floating on top of the metal bath. The trickling metal and slag has the composition indicated in Table I.

TABLE I

[Metal Slag Temp., 3,650° F.]

| Metal composition, weight percent | | | | | | Slag composition, weight percent | | | | | | |
|---|---|---|---|---|---|---|---|---|---|---|---|---|
| Fe | C | Si | Mn | P | S | $SiO_2$ | FeO | MnO | $Al_2O_3$ | CaO | MgO | CaS |
| 96.00 | 2.00 | 1.07 | 0.90 | 0.20 | 0.03 | 33.00 | 0.10 | 1.00 | 15.00 | 44.00 | 2.50 | 4.40 |

Into this descending stream of trickling metal and slat there is a continuous injection of solid material and recycle gas comprising of feed ores, limestone, fuel, and gases of carbon dioxide carbon monoxide, hydrogen and water vapor. All the slag in the reaction zone is being oxidized by the oxygen flame and by the ore addition. From the feed ores injected on the slag surface there is a fast reduction of $Fe_2O_3$ and $Fe_3O_4$ into iron (Fe), iron oxide (FeO), and oxygen. The iron oxide (FeO) dissolves in the slag and becomes the main vehicle for transferring the oxygen from the slag to the metal bath for reduction of impurities. Concurrently with feed ore reduction there is rapid decomposing of injected limestone ($CaCO_3$) into lime (CaO) and carbon dixoide ($CO_2$) resulting in fast dissolution of lime to form basic slag; wherein the carbon dixoide is reduced by iron to form iron oxide (FeO) and carbon monoxide (CO). The higher the lime (CaO) content of the slag the greater is the amount of iron oxide (FeO) than can be dissolved in it.

In the combustion zone the carbon monoxide from carbon combustion and recycle gas, surrounds the droplets of metal and slag and reduces the oxides of silicon ($SiO_2$), and maganese oxide (MnO) according to these equations:

$$SiO_2+2CO=Si+2CO_2$$

$$MnO+CO=Mn+CO_2$$

The reduced silicon and manganese alloys with iron in all proportions and is dissolved in the metal bath underneath the slag. The iron oxide (FeO) in the slag diffuses into the metal bath and reacts with silicon and manganese by these equations:

$$Mn+FeO=MnO+Fe$$

$$Si+2FeO=SiO_2+2Fe$$

The two oxides flux together to form a fusible silicates of iron and manganese in the form of $MnO.SiO_2$, a slag compound which rises through the bath into the slag. Some manganese is retained in the metal to decrease the bad effects of sulphur with which it combines forming MnS and replacing iron in the sulphide (FeS).

For the sulphur and phosphorus reduction, in addition to carbon monoxide reaction, lime is injected to keep the slag basic. The sulphur enters the blast furnace mainly from coke and is released into the gas stream as hydrogen sulphide ($H_2S$) or a gaseous compound of carbon monoxide and sulphur (COS) which combines with iron oxide (FeO) by this reaction:

$$FeO+COS=FeS+CO_2$$

The sulphur that combines with iron to form sulphide of iron (FeS) is removed by reduction in presence of basic lime by this chemical reaction:

$$FeS+CaO+CO=CaS+Fe+CO_2$$

The sulphur will be normally retained in the slag as calcium sulphide (CaS). The presence of large volume of basic slag is beneficial because the calcium sulphide (CaS) has a fixed solubility in a given slag and the greater the slag volume per unit weight of metal the greater is the weight of sulphur it will absorb from the metal.

The reduction of phosphorus is expressed by this equation:

$$P_2O_5+5CO=2P+5CO_2$$

The final reduction of phosphorus takes place in the hearth and is completely reduced. The metal with dissolved phosphorus passes through the oxidized slag zone containing iron oxide (FeO). In the presence of iron oxide the phosphorus is oxidized to pentoxide by this equation:

$$2P+5FeO=5Fe+P_2O_5$$

and combines principally with iron oxide (FeO) by this reaction:

$$3FeO+P_2O_5=3FeO.P_2O_5$$

This ferous phosphate then becomes a slag product.

The iron oxide (FeO) is later displaced by lime (CaO) by this reaction:

$$3CaO+3FeO.P_2O_5=3CaO.P_2O_5+3FeO$$

The tricalcium phosphate ($3CaO.P_2O_5$) is quite stable in slag in the presence of excess lime (CaO). For practical phosphorus elimination, the basicity ratio of calcium oxide (CaO) to silicon oxide ($SiO_2$) is maintained above 2:1.

In the metal bath beneath the slag the final purification takes place and the dissolved elements are oxidized in the order of silicon, manganese, phosphorus and carbon. The reactions representing the oxidation of these elements are represented by the following equation:

$$Si\ (in\ Fe)+2O\ (in\ Fe)=SiO_2\ (slag). \quad (1)$$

$$Mn\ (in\ Fe)+O\ (in\ Fe)=MnO\ (slag). \quad (2)$$

$$2P\ (in\ Fe)+5O\ (in\ Fe)+4CaO=4CaO.P_2O_5\ (slag). \quad (3)$$

$$2C\ (in\ Fe)+3O\ (in\ Fe)=CO\ (gas)+CO_2\ (gas). \quad (4)$$

The activities of the substances involved in the above reactions constitute the refining of the metal in the bath. Reaction (1) results in the formation of silicate ($SiO_2$) which is insoluable in steel and goes into the slag. Reaction (2) results in the formation of basic oxide (MnO) which is only slightly soluable in steel, most of it goes into slag. Reaction (3) includes slag-forming compound (CaO) which combines with oxides of phosphorus ($P_2O_5$) and goes into slag as $4CaO.P_2O_5$. Reaction (4) produces the gas carbon monoxide and carbon dioxide. Usually over 90 percent of the gas is carbon monoxide which burns to carbon dioxide above the slag. The elimination of carbon, therefore produces no oxides which require a flux for its removal. There is sufficient oxygen in the combustion gases to oxidize the carbon monoxide to carbon dioxide in order that oxidizing conditions prevail.

During the refining period the bath temperature is maintained at approximately 3,300° F. At this temperature the residual oxygen in the steel reacts with carbon and forms carbon monoxide which gives rise to a boil as it leaves the steel bath and enters the slag. By this boiling action the oxygen content of the steel is reduced to a value that deoxidizers are not required thus eliminating the formation of inclusions in the bath from the deoxidation products. For this condition of the metal bath only a short refining time is required under the slag. The final steel and slag has the composition indicated in Table II.

TABLE II

[METAL TEMP., 3,300° F.]

| Metal composition, weight percent | | | | | | Slag composition, weight percent | | | | | | | | |
|---|---|---|---|---|---|---|---|---|---|---|---|---|---|---|
| Fe | C | Mn | P | S | O, | FeO | $Fe_2O_3$ | CaO | MnO | MgO | $SiO_2$ | $P_2O_5$ | $Al_2O_3$ | S |
| 99.40 | 0.07 | 0.37 | 0.02 | 0.01 | 0.005 | 11.10 | 4.3 | 45.90 | 6.30 | 6.20 | 18.50 | 3.64 | 4.00 | 0.06 |

Figure 3:
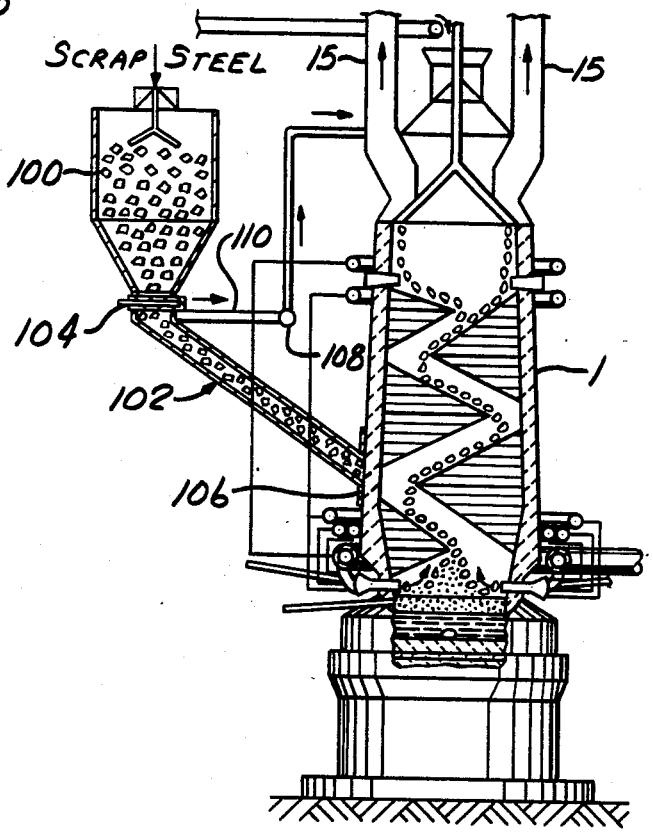
FIG. 3 illustrates an alternative embodiment of the invention including a method for scrap steel addition in the novel process.

The above described process permits direct steel making to be carried out in conjunction with scrap steel recycling as shown in FIG. 3. Specifically, the blast furnace, being free of the packed tower moving column, will have ample free volume to receive a charge of steel scrap. The scrap is injected into the furnace preferably where the temperature in the furnace shaft is about 2400° F. The steel scraps preferably have a maximum size of 12 inches in any direction. The scrap steel is melted down to dilute the molten pig iron pool to no more than about 50% pig iron and 50% steel scrap.

With surplus steel scrap availability increasing as open-hearth furnaces are phased out, a substantial expansion of scrap-based steelmaking is now possible with the above described improvements. The idealized blast furnace and basic oxygen furnace technology, which has only about 25 percent of scrap consuming capacity, could be readily replaced by the method of this invention for consumption and recycling of considerable amounts of steel scrap. This method has a lower cost than the scrap-based electric arc furnace for steel melting.

The steel scrap melting period begins when the first scrap has been injected. It is important to melt the scrap and other solid metallic elements of the charge quickly and to oxidize them by sufficient excess oxygen in the flame so as to have them at such a temperature and degree of oxidation that molten pig iron from direct reduction will not be chilled by the scrap, and the oxidation of the metalloids of the pig iron will not be delayed. A high rate of fuel input is furnished by the oxygen flame already provided, which transfers the maximum number of heat units to the charge over the largest possible area of the charge of molten pig iron and melted steel scrap. Referring to FIG. 3, the metallic iron, containing reduced substance, and the slag containing unreduced substances or oxides together with melted steel, trickles down from the smelting zone and passes through the combustion zone and is then collected in the hearth with the molten slag on top of the metal bath. In the metal bath beneath the slag the final purification takes place substantially as above described.

The steel scrap hopper 100 and a pre-heat chute conveyor 102 are provided for charging the steel scrap into the lower section of blast furnace 1 at a point where the temperature is about 2400° F. A gate valve 104 in the bottom of hopper 100 and a gate valve 106 on furnace 1 at the scrap injection location provide, in the chute conveyor 102 a closed chamber for pre-heating all scrap material before injection into the blast furnace 1. Any hot gases from the blast furnace that enter chute conveyor 102, via gate valve 106 will be removed by a suction fan 108 and a duct 110 leading from conveyor 102 to uptake pipe 15.

These and other embodiments and modifications of applicants novel method having been envisioned and anticipated by the inventor, the invention is to be construed as broadly as permitted by the scope of the claims appended hereto.

I claim:

1. In a method of continuously processing iron ore for direct steel making in an oxygen blast furnace that includes a hearth adjacent a lower portion of the furnace and an elongated shaft extending vertically upward from the furnace hearth, the steps comprising:

charging intermingled process ingredients including iron ore, limestone and coke into an inlet portion of said shaft spaced vertically upward from said hearth;

continuously gravitationally passing a freely falling stream of said intermingled process ingredients along a descending tortuous path which extends within an intermediate portion of said furnace shaft intermediate said inlet portion and the hearth of said furnace and thence to the hearth of said furnace;

continuously delivering a blast of reducing constituents to the hearth of said furnace for combustion thereof to produce a hot reducing gas mixture and directing said hot reducing gas mixture in an ascending stream upwardly through said furnace shaft in countercurrent flow relationship with said freely falling stream of intermingled process ingredients;

capturing at least some of said hot reducing gas mixture;

recycling said at least some of said hot reducing gas mixture by injecting a first portion thereof with additional oxygen into said intermediate portion of said furnace shaft to mingle with said ascending stream;

in conjunction with said continuously delivering, capturing and recycling steps, providing a pair of vertically spaced reaction zones within said furnace including an oxidation zone adjacent the hearth of said furnace and a reduction zone extending vertically above said oxidation zone within said furnace shaft and including said descending tortuous path;

mingling said ascending stream with said freely falling stream of intermingled process ingredients within said reduction zone for the reduction of said process ingredients to provide a continuous molten iron stream including reduced molten iron and slag containing unreduced components;

continuously gravitationally depositing said molten iron stream in the hearth of said furnace to form therein a pool of reduced molten iron and slag containing unreduced components; and directing said blast of reducing constituents at said pool in conjunction with combustion thereof to oxidize said slag containing unreduced components whereby components of the oxidized slag become effective as a vehicle for transferring oxygen from said slag to said reduced molten iron in said pool and for extracting impurities from said reduced molten iron to thereby refine said reduced molten iron into steel.

2. The method as claimed in claim 1 including the additional step of injecting a second portion of said captured hot reducing gas mixture into said furnace adjacent said hearth to form a part of said blast of reducing constituents.

3. The method as claimed in claim 2 including the additional step of injecting fine combustible solids including pulverized iron ore, limestone and coke breeze coincidentally with injection of said second portion into said furnace adjacent said hearth to form a further part of said blast of reducing constituents.

4. The method as claimed in claim 1 wherein said tortuous path includes cascade steps arranged in said intermediate portion of said furnace shaft to provide cascading flow of said freely falling stream of intermingled process ingredients.

5. The method as claimed in claim 1 including the additional step of utilizing said tortuous path to partially obstruct and cool said ascending stream to provide said pair of vertically spaced reaction zones.

6. The method as claimed in claim 5 wherein said reduction zone is maintained at a temperature in the range of approximately 1700° F. to 2000° F.

7. The method as claimed in claim 6 wherein said oxidation zone is maintained at a temperature of approximately 3650° F.

8. The method as claimed in claim 1 including the additional step of injecting scrap steel into said furnace for gravitational delivery thereof to said pool to form a mixture of molten reduced iron and molten scrap steel in said pool.

9. The method as claimed in claim 8 wherein said scrap steel is injected into a zone of said furnace where the temperature is approximately 2400° F.

10. The method as claimed in claim 8 wherein the ratio of molten reduced iron to molten scrap steel being delivered into said pool is approximately 1:1.

11. The method as claimed in claim 7 wherein said reduction zone is maintained at an elevated pressure in the range of 15 to 25 psi above ambient atmospheric pressure.

12. In a method of direct steel making in a blast furnace wherein process ingredients including iron ore, coke and limestone are charged into the furnace shaft and a blast of reducing constituents including hydrocarbon fuel and oxygen is continuously delivered to the hearth of the furnace where combustion thereof produces a hot reducing gas mixture which ascends through the furnace shaft to reduce the process ingredients and which is thereafter recovered as top gases issuing from the top of the blast furnace for recirculation of a first portion of the top gases to the hearth of the furnace to be combined with fine combustible solids and with said hydrocarbon fuel and oxygen to provide the blast of reducing constituents, the improvement comprising:

directing said process ingredients in a continuous free falling stream gravitationally through a tortuous flow path within said furnace shaft in countercurrent flow relationship with said hot reducing gas mixture and providing supplemental heat for reducing of said process ingredients by the injection of oxygen and a second portion of said top gases into said furnace shaft above said tortuous flow path whereby said process ingredients are substantially completely reduced during passage of said process ingredients through said tortuous path.

* * * * *